US005515087A

United States Patent [19]

Lim et al.

[11] Patent Number: 5,515,087

[45] Date of Patent: May 7, 1996

[54] REMAINING BATTERY CAPACITY DETERMINATION METHOD AND APPARATUS

[75] Inventors: Chuin K. Lim, Singapore; Chiau H. Ong, Taigin, both of Singapore

[73] Assignee: Hewlett-Packard Company, Palo Alto, Calif.

[21] Appl. No.: 161,375

[22] Filed: Dec. 2, 1993

[51] Int. Cl.[6] ..... B41J 2/01

[52] U.S. Cl. ..... 347/14

[58] Field of Search ..... 347/19, 14, 109; 400/88

[56] References Cited

U.S. PATENT DOCUMENTS

| | | | |
|---|---|---|---|
| 4,010,456 | 3/1977 | Erni . | |
| 4,351,029 | 9/1982 | Maxey et al. . | |
| 4,525,055 | 6/1985 | Yokoo . | |
| 4,536,697 | 8/1985 | Johnston et al. . | |
| 4,724,528 | 2/1988 | Eaton . | |
| 4,866,471 | 9/1989 | Ikuta . | |
| 4,885,523 | 12/1989 | Koenck . | |
| 4,961,043 | 10/1990 | Koenck . | |
| 4,977,899 | 12/1990 | Digby et al. . | |
| 5,115,182 | 5/1992 | Ehmke et al. . | |
| 5,162,721 | 11/1992 | Sato . | |
| 5,182,583 | 1/1993 | Horigome et al. | 347/19 |
| 5,193,538 | 3/1993 | Ekwall . | |
| 5,203,020 | 4/1993 | Sato et al. . | |
| 5,299,875 | 4/1994 | Hock et al. | 400/625 |

FOREIGN PATENT DOCUMENTS

| | | |
|---|---|---|
| 0265328 | 10/1987 | European Pat. Off. . |
| 4194689 | 7/1992 | Japan . |
| 5150020 | 6/1993 | Japan . |

*Primary Examiner*—Benjamin R. Fuller
*Assistant Examiner*—Craig A. Hallacher

[57] ABSTRACT

Method and apparatus for monitoring actual usage of a battery in an ink-jet printer are described. The apparatus partitions a battery-operated or battery-backed up ink-jet printer into its various current-consuming subsystems or modules including sheet advance motor, carriage motor, printhead, logic and sleep circuitry. Firmware within the printer's controller monitors actual usage of each of the modules as a representation of energy consumption thereby and indicates the remaining battery capacity over the life of the printer. Motor usage is monitored by measuring sheet advance mechanism feed motor and printhead carriage drive motor travel distances; printhead usage is monitored by counting ink-jet firings; logic and sleep circuitry usage also may be monitored by estimating. Remaining battery capacity is determined, and optionally indicated more accurately and at negligible cost.

16 Claims, 2 Drawing Sheets

REMAINING BATTERY CAPACITY DETERMINATION METHOD AND APPARATUS

TECHNICAL FIELD

The present invention relates generally to battery-powered or backed-up systems such as ink-jet printers. More particularly, the invention concerns method and apparatus for determining and indicating the remaining battery capacity of such systems based upon actual usage of the printer's various subsystems such as printhead carriage travel, sheet feed mechanism travel and ink-jet firing count.

BACKGROUND ART

Conventionally, so-called battery "fuel gauges" have been used to track battery current consumption and to manage power in portable, battery-operated devices. Some such power management schemes operate as software tasks by directly measuring on-times of various current-consuming subsystems or modules such as modems and RS-232 interfaces, logic circuitry and power-down, or sleep mode, circuitry. Such conventional method and apparatus are described in U.S. Pat. No. 4,724,528 which issued Feb. 9, 1988 and which is subject to common ownership herewith. Because they rely on direct and/or durational measurements, such method and apparatus inaccurately would predict remaining battery capacity in an ink-jet printer, wherein current consumption is highly variable, e.g. duty cycle- or usage-dependent.

For example, in ink-jet printers providing draft as well as letter quality printing options, carriage on-time measurements would overstate the ink-jet firing and carriage motor currents consumed during draft printing relative to letter quality printing. Similarly, in ink-jet printers equipped with monochrome as well as tri-color pen printheads, printhead on-time measurements would overstate the printhead current consumed during black printing relative to color printing. In other words, with conventional method and apparatus, battery current consumption tracking is dependent upon many variables such as print quality selections, e.g. draft versus letter; pen selections, e.g. black versus color; color reproduction techniques, e.g. error diffusion versus shingling; and sheet advance modes, e.g. automatic versus manual.

Ink drop count-based printer control has been proposed, for the purpose of managing time-averaged power drain on a printer's power supply and for the purpose of increasing printer throughput by servicing pens at optimum times. Such method and apparatus are described in co-pending U.S. patent application Ser. No. 07/951,255 entitled "DROP COUNT-BASED INK-JET PRINTER CONTROL METHOD AND APPARATUS, which is subject to common ownership herewith. The disclosure of that application is incorporated herein by this reference. In accordance with these method and apparatus, the number of firings of each ink-jet pen in the printhead is maintained in memory by the printer's microcontroller or other drop count means, and carriage control is based at least in part thereon. But there is no concern with battery operation, drain thereon or remaining capacity thereof.

DISCLOSURE OF THE INVENTION

The invented method and apparatus partition a battery-operated or battery-backed up ink-jet printer into one or more of its various current-consuming subsystems or modules including sheet advance motor, carriage motor, printhead, logic and sleep circuitry. Firmware within the printer's controller monitors actual usage of each of the modules as a representation of energy consumption thereby and indicates the remaining battery capacity over the life of the printer. Motor usage is monitored by measuring the travel distances of the sheet advance and printhead carriage mechanisms; printhead usage is monitored by counting ink-jet firings; logic and sleep circuitry are monitored by estimating usage based upon activity and predetermined current consumption parameters. Greatly improved accuracy in indicating a battery's recharge or replacement requirement averts overcharging and prolongs battery life. Yet prior art direct measurements of battery current draw, as by the use of analog-to-digital converters (ADCs), and the attendant cost, is avoided.

These and additional objects and advantages of the present invention will be more readily understood after a consideration of the drawings and the detailed description of the preferred embodiment.

DETAILED DESCRIPTION OF THE PREFERRED EMBODIMENT AND BEST MODE OF CARRYING OUT THE INVENTION

Figure 1:
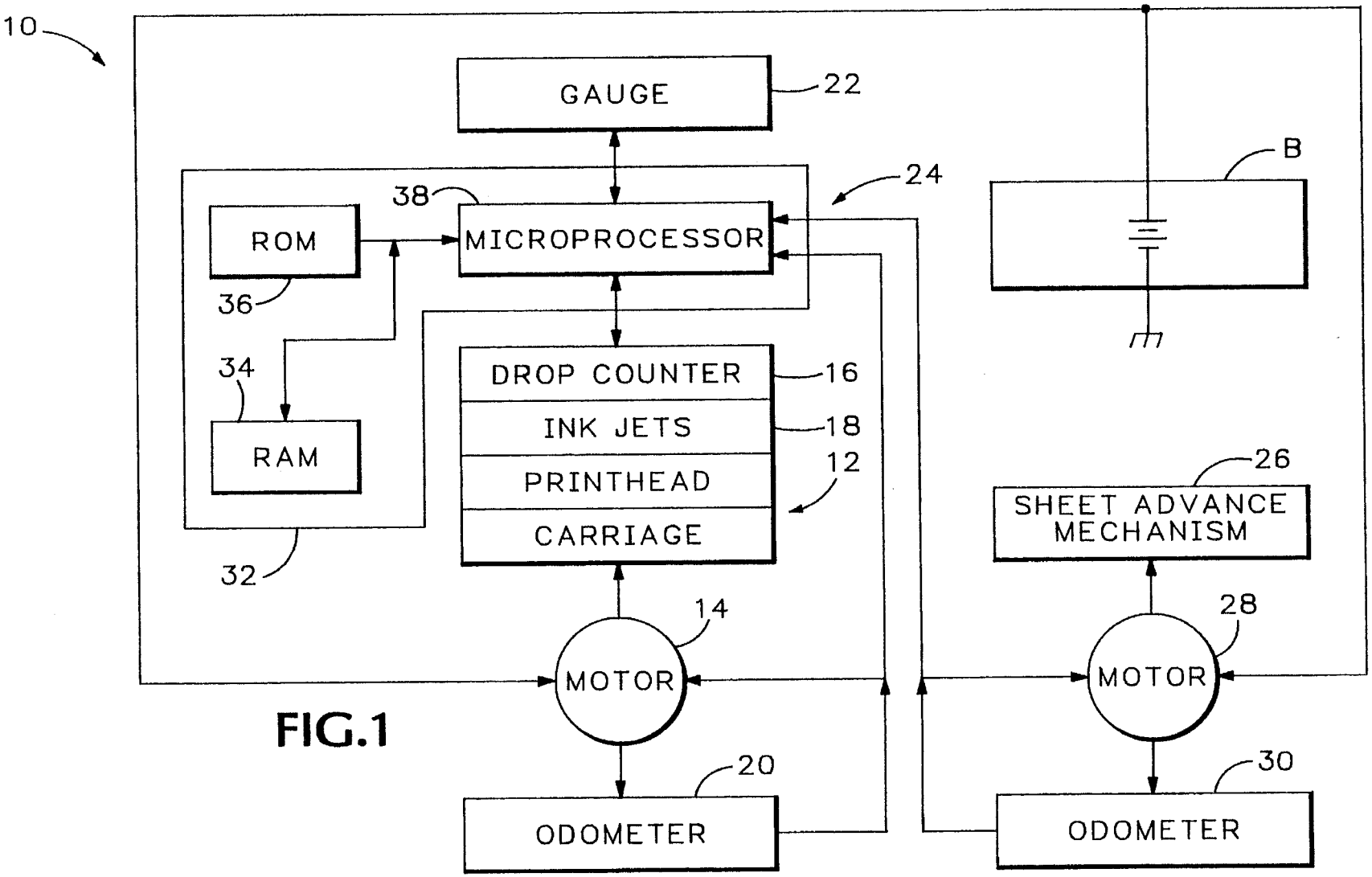
FIG. 1 is a schematic block diagram of the apparatus of the invention made in accordance with its preferred embodiment.

FIG. 1 schematically and in block diagram form shows battery capacity determining apparatus 10 for a battery-operated ink-jet printer that includes a battery B (which may be its only DC power source, as in a portable printer, or which may form a part of an uninterruptible power source (UPS) for backing up a main AC-converted DC power source) and a carriage-mounted printhead 12 driven by a carriage motor 14. Apparatus 10 may be seen to include an ink drop counter 16 for determining the cumulative number of times the printhead's ink jets 18 are fired; a first odometer 20 for measuring the cumulative travel distance of the printhead carriage (which may be determined by measuring the rotational travel of the carriage motor, e.g. by counting the cumulative number of stepper pulses); a remaining battery capacity, or fuel, gauge 22 indicating remnant battery capacity; and a controller 24 responsive to counter 16 and to first odometer 20 and operatively coupled with gauge 22 for determining the energy consumed by ink jets 18 and by carriage motor 14 and for periodically updating the remnant battery capacity indication produced by gauge 22.

Counter 16 and first odometer 20 preferably are implemented in firmware executed by a microprocessor within the printer. Typically, the printer further includes a sheet advance mechanism 26 driven by a feed motor 28. In such case, apparatus 10 further includes a second odometer 30 for measuring the cumulative travel distance of sheet advance mechanism 26 (which may be determined by measuring the rotational travel of feed motor 28, e.g. by counting the cumulative number of steps of a stepping feed motor). In this way, controller 24 is responsive further to second odometer 30 and determines further the energy consumed by feed motor 28 and updates such indication based thereon. Also typically, the printer further includes digital logic circuitry 32 including, for example, miscellaneous buffers, drivers, gates and part or all of the logic circuitry that forms controller 24. In such case, controller 24 estimates the energy drawn from battery B by digital logic circuitry 32 and updates such indication based thereon.

Apparatus 10 typically further includes a read-and-write memory (RAM) 34 operatively coupled with or forming a part of controller 24, with memory 34 storing a count from counter 16, storing a travel distance from first odometer 20 and storing a remnant battery capacity indication from gauge 22. Preferably, gauge 22 produces an audio or visual indication of remnant battery capacity, upon a predetermined condition thereof determined by controller 24, to the printer's user. Gauge 22 preferably is implemented at least partly in firmware, e.g. firmware stored within a read-only memory (ROM) 36, and the firmware is executed by a microprocessor 38 that forms a part of controller 24 of the printer. The remnant battery capacity indication is calculated by microprocessor 38 or other suitable means. Gauge 22 produces an audio or visual indication of remnant battery capacity, upon a predetermined condition thereof determined preferably by microprocessor 38, to the printer's user.

Battery B of apparatus 10 is operatively connected to any printer component that requires energy, such as carriage-mounted printhead 12, microprocessor 38, carriage motor 14 and feed motor 28, etc. FIG. 1 shows battery B connected only to carriage motor 14 and feed motor 28 for the sake of simplicity.

Figure 2:
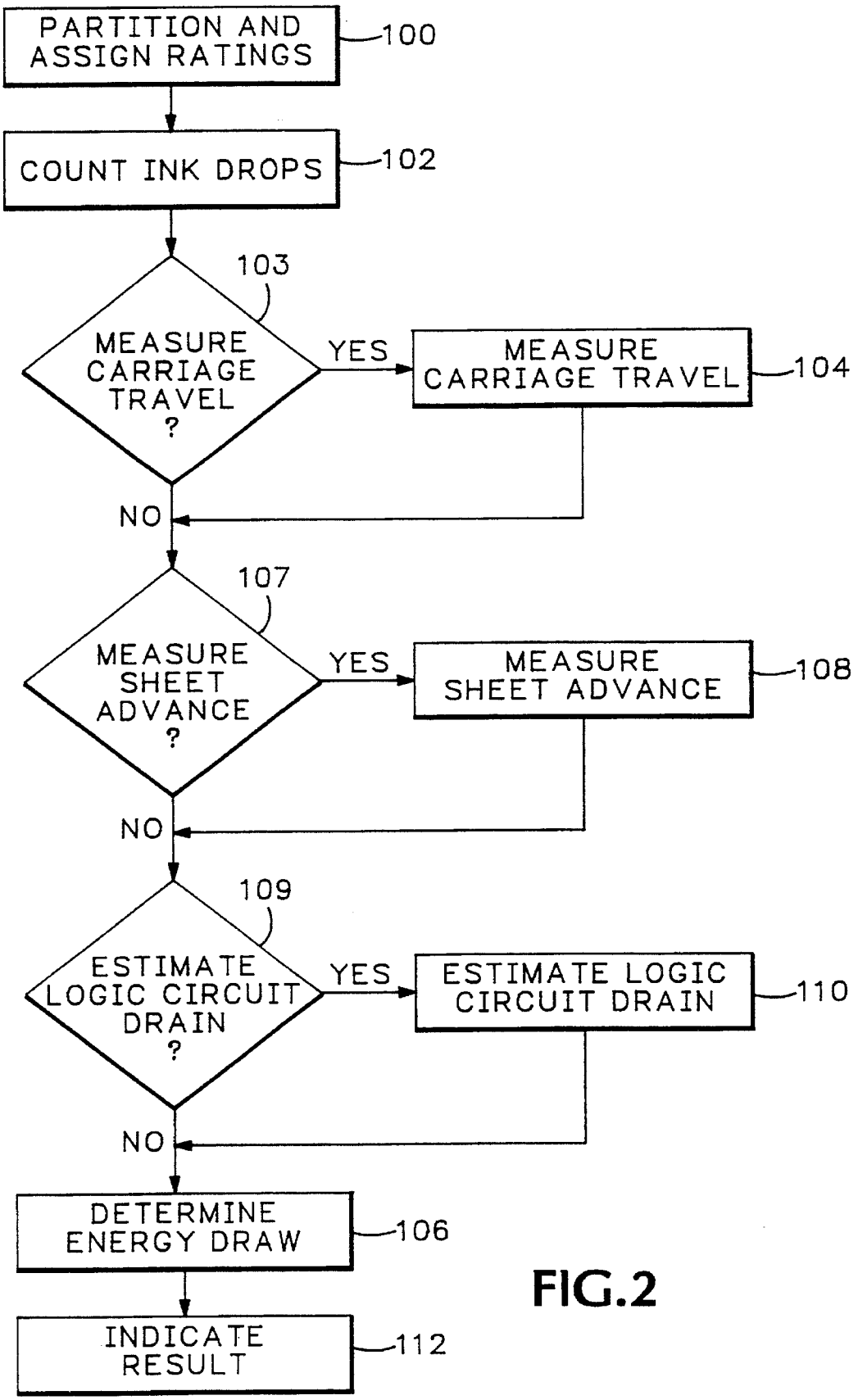
FIG. 2 is a flowchart illustrating the invented method.

The preferred method of the invention now readily may be understood by reference to FIG. 2, and from the disclosure above of the preferred embodiment. As may be seen from the flowchart of FIG. 2, the preferred method is useful for determining remaining battery capacity in an ink-jet printer having a controller such as controller 24, digital logic circuitry such as circuitry 32, a carriage-mounted printhead such as printhead 12, a sheet advance mechanism such as mechanism 26 and a battery such as battery B shown in FIG. 1. Inherent in the invented method is a partitioning of the printer into one or more of its primary battery current drain subsystems and assigning each a nominal current or energy rating, e.g. in milliamperes (mA) or mA-hours, as indicated at 100. The invented method then preferably involves 1) counting ink drops fired from the printhead and storing the same in a memory, as indicated at 102; if carriage travel should be measured (as determined at 103), then 2) first measuring the distance of travel of the carriage and storing the same in a memory, as indicated at 104; and 3) determining the energy drawn from the battery over time by the printhead and optionally by the carriage motor, the determining step including monitoring the stored result at least of the counting and preferably also of the first measuring step, as indicated at 106. It will be understood that certain desirable, but unnecessary, steps of the preferred method are shown in FIG. 2 with dashed lines indicating paths thereabout.

Skilled persons will understand that drop-counting step 102 may be accomplished in accordance with the teachings of the above-referenced patent by counting physical droplets in accordance with prior art teachings or by any other suitable means or in any other suitable manner. Those skilled in the art also will understand that first measuring step 104 straightforwardly may be accomplished by counting the command pulses produced by controller 24 in stepping carriage motor 14, representative of the distance of carriage travel. The results of these steps (which may be stored in RAM 34) may be used in conjunction with predefined constants (which may be stored in ROM 36) regarding nominal ink-jet printhead and carriage motor currents to calculate energy consumption throughout the life of battery B.

Preferably, if the sheet advance should be measured (as determined at 107), then the method further involves 4) second measuring the distance of travel of the sheet advance mechanism and storing the same in a memory, as indicated at 108. This second measuring step 108 may be performed similarly to that of first measuring step 104, described above, but by counting stepper or command pulses to feed motor 28. When this further step is performed, determining step 106 further monitors the stored result of such second measuring step, as indicated in FIG. 2.

Also preferably, if the logic circuit drain should be estimated (as determined at 109), then the method further involves 5) estimating the energy drawn from the battery by the digital logic circuitry and storing the same in a memory, as indicated at 110. This estimating step 110 may also include estimating the energy drawn from the battery by a subset of the printer's digital logic circuitry commonly referred to as sleep logic, i.e. that logic circuitry involved in a power-down, or sleep, mode of the printer. When this further step is performed, determining step 106 further monitors the stored result of such estimating step, also as indicated.

When both second measuring step 108 and estimating step 110 are performed, determining step 106 further monitors the stored results of such second measuring step 108 and of such estimating step 110, as indicated.

Such determining step 106 might, for example, simply sum the various energy consumption components of the various subsystems (e.g. of ink jets 18, carriage motor 14, feed motor 28 and digital logic circuitry 32) to determine the total energy consumption, e.g. in mA-hours, for the printer. This calculated energy consumption in turn simply might be subtracted from the battery's nominal or rated energy capacity, which has been stored in ROM 36. While not shown in FIG. 2, it will be appreciated by those skilled in the arts that microprocessor 38 straightforwardly may be programmed to monitor such stored results; to calculate energy consumption based thereon; to calculate remnant battery capacity based upon historic consumption and stored, nominal battery capacity ratings; and to determine therefrom when and what to do next.

Those of skill in the arts will appreciate that controller 24 may make any appropriate decision regarding power management, based upon such determining step. For example, controller 24 automatically might prevent, or at least caution, the user from charging the battery when such is unnecessary and/or when such might result in over-charging. Alternatively, controller 24 automatically might reprogram certain printer start-up parameters such as when to go into sleep mode, thereby better to manage battery power usage. If battery B forms a part of a UPS, then controller 24 automatically could commence recharging of the battery upon a predetermined remnant battery capacity, thereby extending the battery's life. Any suitable determinations, or decision-making, by controller 24 based upon the counting, measuring and estimating steps described and illustrated herein are within the spirit and scope of the invention, including a preferred indicating step to be described immediately below.

Preferably, a final step of the invented method involves 6) indicating to the printer's user the result of determining step 106, as by any suitable audio, visual or other means, as indicated at 112. Those of skill in the arts will appreciate that a light-emitting diode (LED) may be illuminated or an audio transducer may be beeped by controller 24 upon such condition, thereby instructing the printer's user to recharge or replace battery B. Alternatively, a numerical or graphical indication of remnant battery capacity may be produced, e.g. on a liquid crystal display (LCD) on the printer's operator console. Any suitable means or manner of indicating is within the spirit and scope of the invention.

As described above by reference to FIG. 1 showing the preferred embodiment of the invention, counting step 102 and first measuring step 104 preferably are performed by the printer's controller 24 and counting step 102 is performed by counting the number of times the printhead's ink jets are fired. Skilled persons will appreciate that inkdrop-counting step 102 alternatively, yet within the spirit and scope of the invention, may be performed with hardware assistance or by a physical ink drop counter. Skilled persons also will appreciate that within the spirit and scope of the invention measuring step 104 also may be performed with hardware assistance, as by an elapsed-time circuit external to one or both of microprocessor 38 and controller 24, or by any other suitable means or in any other suitable manner.

Industrial Applicability

It may be seen than that the invented method and apparatus provide greatly improved accuracy in remnant battery life determination, and optional indication, over comparably priced, battery-operated printer systems. Such determinations are rendered independent of letter or draft print quality by counting ink drops or ink jet firings rather than the simple expedient of measuring the printhead's on-time. They also are rendered independent of monochrome or tri-color print options wherein tri-color blending requires more ink jet firings than does monochrome printing. They also are rendered independent of carriage motor speed, which is variable in many ink-jet printers, by measuring the travel distance rather than on-time of the printhead's carriage. They are rendered independent of sheet advance mode, whether automatic or manual, by measuring the travel distance rather than on-time of the sheet advance mechanism's motor. These variables in battery energy consumption, as well as those in the digital logic and sleep circuitry of the printer, are comprehended cost effectively, e.g. by straightforward changes to the printer controller's firmware and by use of the printer's operator console display.

While the present invention has been shown and described with reference to the foregoing operational principles and preferred embodiment and method, it will be apparent to those skilled in the art that other changes in form and detail may be made therein without departing from the spirit and scope of the invention as defined in the appended claims.

We claim:

1. A method for determining remaining battery capacity of a battery having an initial battery capacity in an ink-jet printer, said printer having a printhead with ink jets, a controller with an associated memory and the battery, wherein the battery is operatively connected to the printhead for supplying energy to the ink jets of the printhead to fire ink drops therefrom, wherein firing an ink drop causes the printhead to draw an amount of energy from the battery, the method comprising the steps of:

counting ink drops fired from the ink jets to produce a drop count and storing the drop count in the memory;

monitoring the drop count stored in the memory to determine a cumulative amount of energy drawn from the battery by the printhead; and comparing the determined cumulative amount of energy drawn from the battery with the initial battery capacity of the battery to determine the remaining battery capacity.

2. A method for determining remaining battery capacity of a battery having an initial battery capacity in an ink-jet printer, said printer having a controller with an associated memory, digital logic circuitry, a printhead with ink jets mounted on a carriage, a sheet advance mechanism, a feed motor for moving the sheet advance mechanism and the battery, wherein the battery is operatively connected to the printhead for supplying energy to the ink jets of the printhead to fire ink drops therefrom, wherein firing an ink drop causes the printhead to draw an amount of energy from the battery, the battery is operatively connected to the digital logic circuitry and operation of the digital logic circuitry draws an amount of energy from the battery, the battery is operatively connected to the carriage motor for supplying energy to the carriage motor to move the carriage, wherein moving the carriage over a given travel distance causes the carriage motor to draw an amount of energy from the battery, and the battery is operatively connected to the feed motor for supplying energy to the feed motor to move the sheet advance mechanism, wherein movement of the sheet advance mechanism over a given travel distance causes the feed motor to draw an amount of energy from the battery, the method comprising the steps of:

counting ink drops fired from the printhead to produce a drop count and storing the same in a memory;

measuring a cumulative travel distance of the carriage and storing the travel distance in the memory;

monitoring the drop count stored in the memory and the travel distance stored in the memory to determine a cumulative amount of energy drawn from the battery; and comparing the determined cumulative amount of energy drawn from the battery with the initial battery capacity to determine the remaining battery capacity.

3. The method of claim 2 which further comprises second measuring a second cumulative travel distance of the sheet advance mechanism and storing the second travel distance in a memory, wherein said monitoring step further monitors second travel distance.

4. The method of claim 2 further comprising determining a cumulative amount of energy drawn from the battery by the digital logic circuitry and storing the cumulative amount of energy drawn in the memory, wherein said monitoring step further monitors the determined cumulative amount of energy drawn from the battery by the logic circuitry.

5. The method of claim 2 further comprising:

measuring the travel distance of the sheet advance mechanism and storing the travel distance of the sheet advance mechanism in the memory, and determining the amount of energy drawn from the battery by the digital logic circuitry, storing the amount of energy drawn from the battery by the digital logic circuitry in the memory, wherein said monitoring step further monitors the stored travel distance of the sheet advance mechanism and the determined amount of energy drawn from the battery by the digital logic circuitry.

6. The method of claim 5 which further comprises indicating to the printer's user the result of said determining step.

7. The method of claim 2 which further comprises indicating to the printer's user the result of said determining step.

8. The method of claim 2, wherein said counting and said first measuring are performed by the printer's controller and wherein said counting step is performed by counting a number of times the ink jets are fired.

9. Battery capacity determining apparatus for a battery-operated ink-jet printer including a printhead having ink jets, mounted on a carriage, the carriage being driven by a stepping carriage motor, a battery having an initial capacity, the battery being operatively connected to the printhead for supplying energy to ink jets of the printhead to fire ink drops therefrom, wherein firing an ink drop causes the printhead to draw an amount of energy from the battery, and the battery being operatively connected to the carriage motor for supplying energy to the carriage motor to move the carriage, wherein moving the carriage a given number of steps causes the carriage motor to draw an amount of energy from the battery, the apparatus comprising:

an ink drop counter for determining a count representing a cumulative number of times the ink jets are fired;

an odometer for measuring a cumulative number of steps of the carriage motor;

a controller operatively connected with and responsive to said counter and operatively connected with and responsive to said first odometer for determining a cumulative amount of energy consumed by the ink jets and by the carriage motor; and a remaining battery capacity gauge responsive to said determined cumulative amount of the energy drawn from the battery for indicating a remnant battery capacity, wherein said remaining battery capacity gauge is periodically updated by said controller.

10. The apparatus of claim 9, wherein said counter and said first odometer are implemented in programmed instructions executed by a microprocessor within the printer.

11. The apparatus of claim 9 in which the printer further includes a sheet advance mechanism driven by a stepping feed motor operatively connected to the battery for moving the sheet advance mechanism, wherein moving the sheet advance mechanism over a given number of steps causes the stepping feed motor to draw an amount of energy from the battery, the apparatus further comprising:

an additional odometer for measuring a cumulative number of steps of the stepping feed motor, wherein said controller is further responsive to said second odometer and determines a cumulative amount of energy drawn by the stepping feed motor.

12. The apparatus of claim 9 in which the printer further includes digital logic circuitry operatively connected to the battery, wherein operation of the digital logic circuitry draws an amount of energy from the battery, wherein said controller is further responsive to the digital logic circuitry and said controller estimates a cumulative amount of energy drawn from the battery by the digital logic circuitry.

13. The apparatus of claim 9 which further comprises a memory operatively coupled with said controller, wherein said memory stores a count from said counter, a travel distance from said first odometer and a remnant battery capacity indication from said gauge.

14. The apparatus of claim 13, wherein said gauge produces an audio or visual indication of remnant battery capacity, upon the occurence of a predetermined condition thereof as determined by said controller, to a user.

15. The apparatus of claim 9, wherein said gauge is implemented in programmed instructions executed by a microprocessor within the printer and wherein such remnant battery capacity indication is calculated thereby.

16. The apparatus of claim 15, wherein said gauge produces an audio or visual indication of remnant battery capacity, upon the occurence of a predetermined condition thereof as determined by said microprocessor, to a user.

* * * * *